US005289921A

United States Patent [19]

Rodrigo et al.

[11] Patent Number: 5,289,921

[45] Date of Patent: Mar. 1, 1994

[54] ELUTRIATION APPARATUS AND METHOD FOR CLEANING GRANULES

[75] Inventors: Richard D. Rodrigo, Line Lexington; Timothy A. Good, Royersford, both of Pa.

[73] Assignee: Illinois Tool Works Inc., Glenview, Ill.

[21] Appl. No.: 308,110

[22] Filed: Aug. 17, 1992

[51] Int. Cl.[5] ..... B03B 1/00; B03D 3/00

[52] U.S. Cl. ..... 209/3; 209/129; 209/138; 361/213

[58] Field of Search ..... 209/3, 8, 127.1, 129, 209/130, 138, 127.4; 361/212, 213, 230, 231

[56] References Cited

U.S. PATENT DOCUMENTS 2,915790 12/1959 Rice ..... 209/138
4,299,693 11/1981 Paulson ..... 209/3
4,596,497 6/1986 Yamada et al. ..... 209/3
4,631,124 12/1986 Paulson ..... 209/3

*Primary Examiner*—Kenneth W. Noland
*Attorney, Agent, or Firm*—Stanley Bilker; Paul Maleson

[57] ABSTRACT

Granule cleaner and method comprises a hollow elutriation column into which dust- and debris-adulterated pellets are blasted on a high velocity air stream through an upwardly inclined injection tube to form a floating suspension in said column. Suction withdraws the lighter suspended material from the top while the heavier particles fall to the bottom. A.C. electrostatic dischargers diametrically disposed opposite conductive portions of the injection tube which may be ground-isolated (and also opposite ground-isolated conductive portions of the column below the injection level of the granules therein) to neutralize both the entering contaminated granules and the falling cleansed pellets, the conductive ground-isolated portions defining reference electrodes for balancing ion emission.

13 Claims, 5 Drawing Sheets

8
15
14
C
A
2
10A
19
10
24
B1
12
B
25
18
44
22
74
42
70
72
16
E

ELUTRIATION APPARATUS AND METHOD FOR CLEANING GRANULES

BACKGROUND OF THE INVENTION

1. Field of the Invention

This invention relates to granule or particle cleaning, and more particularly relates to an apparatus and method for separating shavings, fines, dust and debris from granular material, pellets and the like or small components or parts which have been or are susceptible to electrostatic charge build-up as a result of exposure to electrostatic fields or by tumbling against one another or by virtue of triboelectric charges produced on such materials by way of friction.

The present invention is derived from a process, known as "elutriation" wherein a volume of random-sized particles or pellets are blown into a vertical column or tube such that they become fluidized and temporarily suspended therein, the lighter weight particulate consisting of dust, fines and debris being drawn off by suction or other means for disposal while the larger size fall by gravity where they are collected for recycling or re-use. In the instant invention, balanced bipolar ionized air is used to neutralize the particles before they are thrust into the elutriation column for separation of the electrostatically adhered particles from each other prior to assortment and thereafter the falling granules which are to be reclaimed are again subjected to a balanced bipolar ionized air static neutralization as they drop through the lower portion of the elutriation column prior to collection.

The bipolar air stream acting on the granules prior, during and subsequent to separation from the entrained fines employs pointed static eliminators which are coupled to opposite sides of a high voltage A.C. power supply and including a reference electrode (adjacently spaced from the points to define an air gap with respect thereto) which is isolated from ground, whereby the reference electrode floats and provides a bipolar, dual phase balanced ion emission. In the present invention the reference electrode comprises the injection tube or the lower portion of the elutriation column into which the static eliminators are contained, both being conductive to enable ion emission from the points.

2. Prior Art

U.S. Pat. No. 4,895,642 (Frei) shows a process for separating particles of non-conductive, plastic material from comminuted waste by first subjecting the ground waste material to electrostatic charging and then fluidizing the charged particles on an upwardly directed stream of air. While the charged particles are in a state of suspension, they are electrostatically attracted to a transverse conveyor whereupon they are separated from the non-charged material and conveyed away.

U.S. Pat. No. 4,299,693 shows a fluidized bed wherein an inlet conduit injects fines and product entrained in a propellant gas at the bottom of a housing whereby the fines are drawn off at the top while the product falls to the bottom. An electrostatic charge neutralizing magnetic field envelops the adulterated product before it impinges against the impact surface of a baffle.

In U.S. Pat. Nos. 4,631,124 and 5,035,331 to Paulson, dust and impurity-laden particulate material is fed by gravity through a tortuous path and a linear-kinetic, magnetic field, energy cell which is said to generate an electric field to neutralize static charges causing dust to adhere to such particles.

In U.S. Pat. No. 3,475,652 to Levy, there is shown a dual or bi-phase static eliminator system for neutralizing a stream of powdered material through a conduit. Pairs of multi-pointed bars having A.C. high voltage applied to each set of points but at 180° out-of-phase whereby the output of one of the pair is one-half cycle behind that of the other. Thus, one of the paired static bars delivers ions of a given polarity toward the conveyed materials during any portion of the cycle while the other supplies ions of the other polarity. The static bars of this patent utilize a grounded casing adjacently spaced from the points, as a result of which an unbalanced predominance of negative ions is produced because of lower negative corona offset voltages and the greater mobility of negative ions.

In U.S. Pat. No. 5,008,594 (Swanson et al), there is set forth a self balancing circuit for convection air ionizers wherein the points of the ion emitter are capacitvely coupled to the A.C. high voltage power supply while the adjacently spaced collector plate is similarly connected to ground through a capacitor. It is said that the capacitive isolation of the external charge sources or sinks maintain a zero average balance and produce a charge balanced system.

In U.S. Pat. No. 5,055,963 (Partridge), the ionizing points of the pairs of the dual phase static neutralizers are coupled to the opposite sides of the A.C. high voltage. These emitter points and the high voltage power supply are completely isolated from any direct current path to ground. The electrodes acquire a D.C. bias that maintains an equal output of positive and negative ions without need for air ion sensors or feedback for balancing.

In our prior U.S. Pat. No. 5,153,811, granted Oct. 6, 1992, we show and describe a self-balancing ionizing circuit for static eliminators wherein pointed electrodes were directly coupled to one side of an A.C. high voltage transformer while the other side of the transformer is directly coupled resistively to an ungrounded conductive band supported within an insulative sheet peripherally spaced from the discharge electrodes to define a floating reference electrode with respect to the points. Grounding is only effected by way of an external conductive chassis which is shielded from the internal ionization system by way of the dielectric of the insulative casing. It is taught that isolating the reference electrode from ground permits substantial voltages to be developed on said reference electrode without creating the ionization imbalance normally produced by adjacent grounded components. Balancing of positive and negative ion production is shown to be independent of capacitors or other electrical components, and no mechanical adjustment is required to compensate for changes in environmental factors or contamination conditions.

U.S. Pat. Nos. 4,046,492 and 4,195,780 show and describe air flow amplifiers for directing a stream of pressurized fluid through a nozzle.

3. Objectives of this Invention

The instant invention is particularly useful for recycling plastic components, such as rejects, or re-use of plastic materials previously contemplated for throw-away. The reject or throwout plastic components are first ground in a mill to a particular size, such as granules or pellets whose dimensions range from about 0.125 inch to 0.375 inch, and then introduced into a charge load or feedstock for molding or extrusion. However, these ground materials not only contain entrained dust, and fine particulate or other debris, but also this fine material as well as the granules themselves are statically charged as a result of the grinding operation such that they adhere to each other by electrostatic attraction. Foreign particles and other fines in the mix tends to cause burning, charring and other discoloration in the remolded articles.

It is therefore an object of this invention to provide a method and apparatus for cleaning granules having dust, dirt and other particulate entrained therein so that the cleaned granules may be collected for re-use and/or recycling.

Another object of this invention is to provide a method and apparatus for providing for continuous cleaning of plastic granules but readily adapted for batch mode.

Still another object of this invention is to provide a conveying system for elutriation and cleansing of dirty granules in which dual-phase opposing static eliminators are employed wherein the net charge on articles emerging therefrom will be minimal.

Yet still another object of this invention is to provide a fully balanced static ionizer for neutralization of particles wherein there will be full compensation with respect to ion balance for (1) line voltage fluctuation, (2) dirt build-up on ion emitters and (3) emitter erosion.

Other objects of this invention are to provide an improved device and method of the character described which is easily and economically produced, sturdy in construction and both highly efficient and effective in operation.

SUMMARY OF THE INVENTION

In accordance with the present invention, there is provided means for injecting granules and fines (termed adulterated or dirty granules) on a stream of ionized air into an elutriation column to define a fluidized bed wherein the granules and fine particulate entrained therewith are temporarily maintained in floating suspension. The injection means includes a pair of opposed dual polarity electrostatic eliminators subjecting the dirty granules to bipolar ions and serving to neutralize the charges which bind any dirt, debris, dust or particulate material to the granules themselves. At the same time, a high velocity air jet propels the mixture into the elutriation column and strips the fine particulate from the granules. Inside the elutriation column, a suction or vacuum above the floating suspension draws the lighter weight particulate from the upper portion of the fluidized bed while the heavier weight granules are separated by gravity and fall through a second set of diametrically opposed dual polarity static eliminators where they are neutralized of any residual charges and collected for recycling. The static eliminators are pointed electrodes which are adjacently spaced from a conmductive reference electrode to produce localized electrical breakdown of the air or other gaseous medium brought about by high surface charge density at the points. The corona produced on each set of needle electrodes on the oppositely arranged static bars causes the electrodes of the respective bars which are coupled to the opposite ends of an AC high voltage source to emit ions of each polarity on successive half cycles of the alternating voltage waveform.

Dual phase power sources are used to drive the adjacently opposed bars so that positive and negative ions are produced simultaneously. A center-tapped-to-ground transformer power supply has its high voltage terminals connected to the bars of opposing polarity at any particular time. By avoiding any adjacent ground to the reference electrodes enables the ion emission to be balanced without independent mechanical or electrical balancing devices.

BRIEF DESCRIPTION OF THE FIGURES

With the above and related objects in view, this invention consists of the details of construction and combination of parts as will be more fully understood from the following detailed description when read in conjunction with the accompanying drawings, in which.

DETAILED DESCRIPTION

Figure 1:
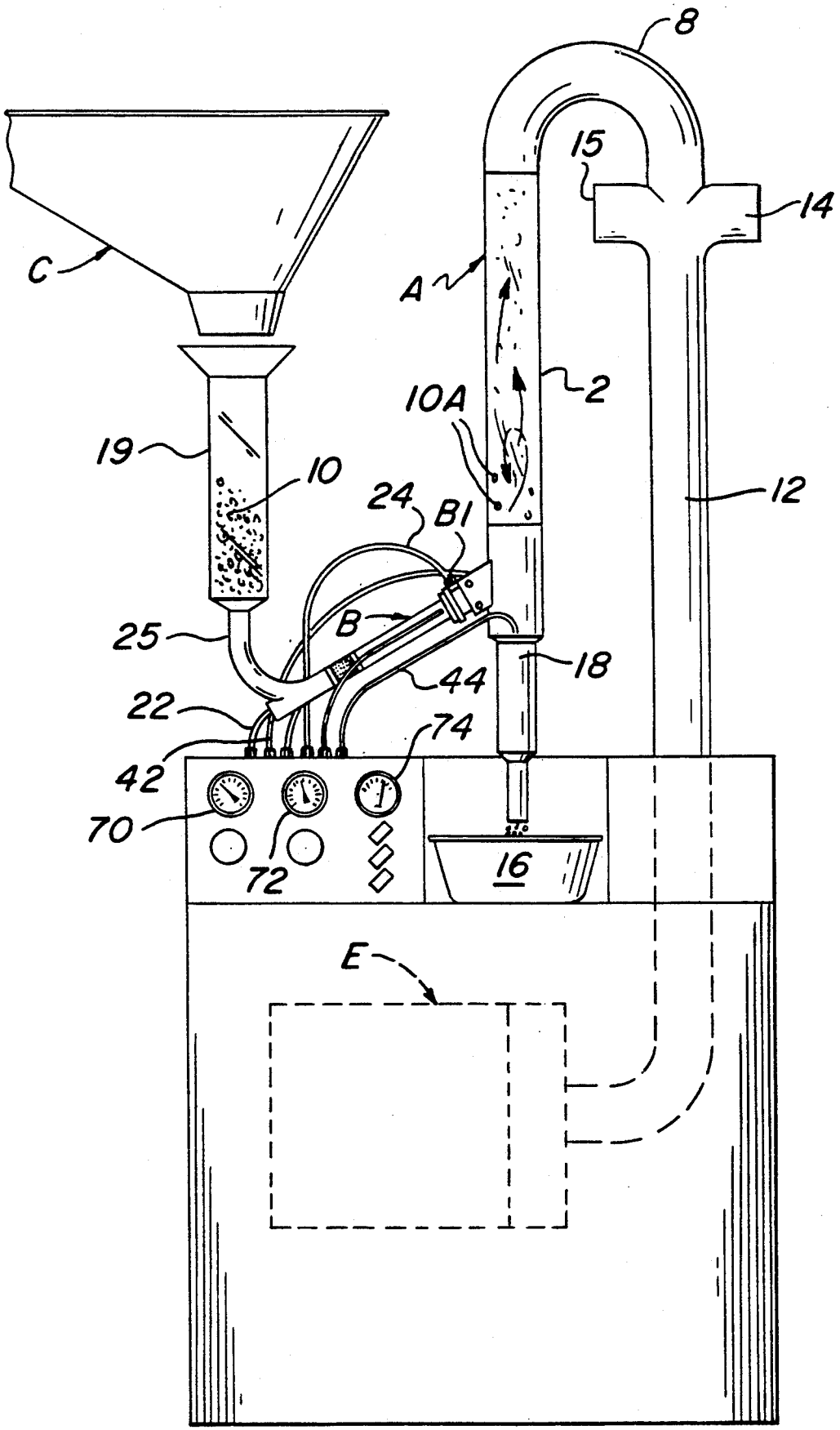
FIG. 1 is a front elevational view of a granule cleaning apparatus embodying this invention.
Figure 2:
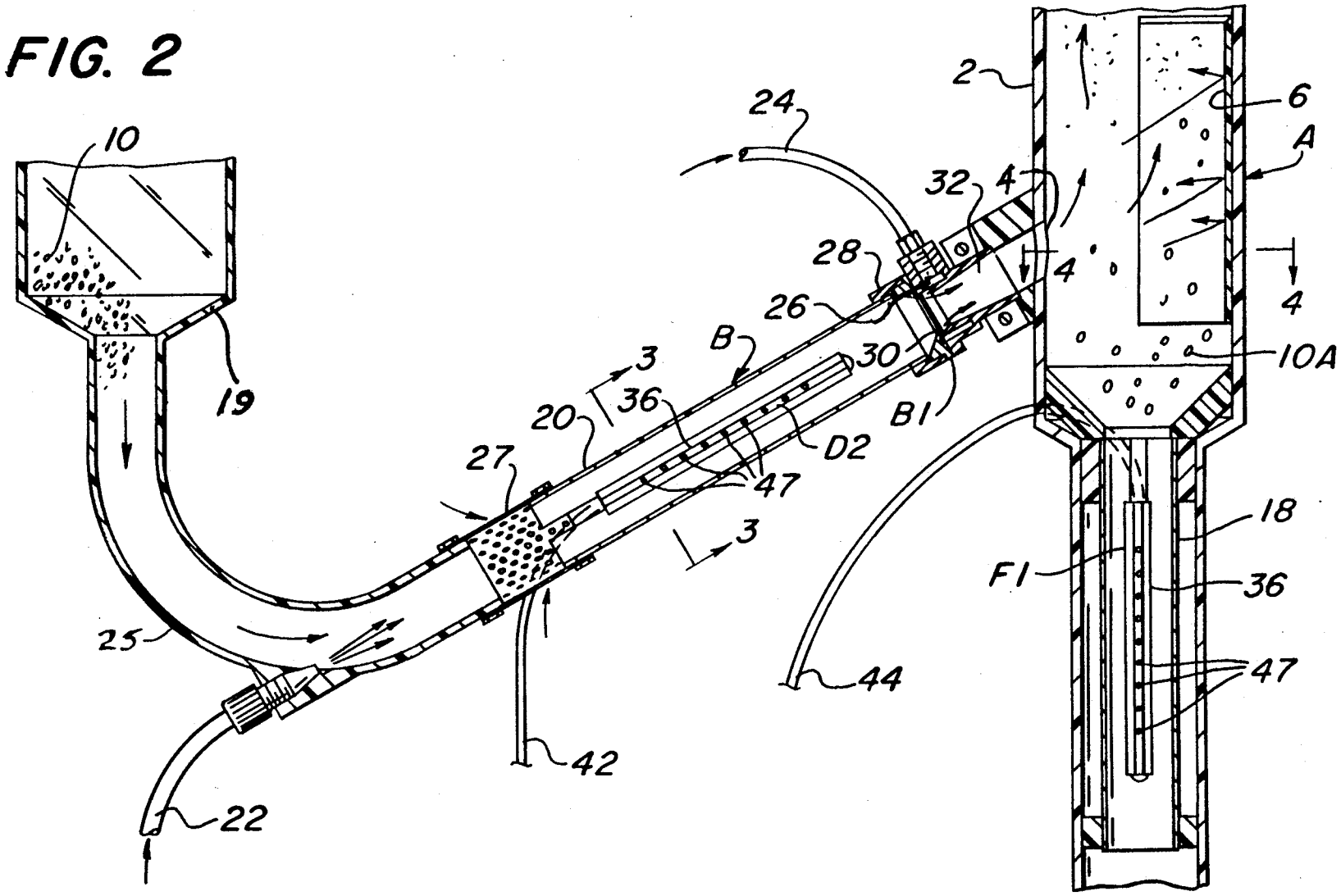
FIG. 2 is a sectional view taken generally laterally through FIG. 1 on a plane parallel to the plane of the paper.

Referring now in greater detail to the drawings in which similar reference characters refer to similar parts, there is shown in FIGS. 1 and 2 an apparatus for cleaning granules comprising a hollow elutriation column, generally designated as A, into which adulterated ("dirty") granules 10 are injected in a generally upward direction on a high velocity air stream from a propulsion tube B whereby both the granules and fine particulate released therefrom become temporarily suspended and transiently float within a medial portion of the elutriation tube. A feed hopper C loads a propulsion tube B where they are transported into communication with an air amplifying nozzle B1, (termed a Transvector, manufactured by Vortec Corporation of Cincinnati, Ohio) located immediately before a port 4 between the upper portion of the injector tube and the lower portion of the elutriation column A. Positioned at diametrically opposite zones of the injection tube B are a pair of elongated static neutralizer bars D1 and D2 which are coupled to an A.C. high voltage power source G so as to subject the granules 10 and any electrostatically adhered particles of dust, dirt and debris whereby they are released from contact with each other and electrostatically neutralized.

The elutriation column A comprises a vertically disposed tube 2, preferably of transparent plastic such as "Lexan" polycarbonate made by General Electric, to permit observation of the fluidized bed at the medial portion of the tube 2. A port 4 enables the dirty granules with entrained dirt and dust to be squirted from the injection tube B against an impact pad 6 in column A and thereafter for flotation within the medial portion of the tube 2. A U-shaped bend 8 at the upper part of the elutriation column descends vertically on tubular conduit 12 into communication with a conventional vacuum or suction device, generally designated as E. The vacuum is sufficient to draw off the lighter weight particulate material (dust, fines and debris) exhausting from the upper zone of the suspended fluidized cloud. Air ports 14 and 15 enable the suction or vacuum from device E to draw off the lighter weight particulate without disturbing the flow in the elutriation column particulate without disturbing the flow in the elutriation column A set up by the air amplifying nozzle B1. The heavier cleansed granules fall to the bottom of the elutration column A for deposit into a clean granule reservoir or collector 16.

Prior to dumping into the collector 16, the cleansed granules 10A fall through a restricted lower portion 18 of column A where they are again subjected to bipolar ions emitted by opposed A.C. static bars F1–F2 mounted in the tube to maintain the clean granules electrostatically neutral. The lower portion 18 of column A is conductive, for example, any suitable metal such as steel, to act as a reference electrode with respect to the discharge electrodes of the static bars F1–F2.

The injection tube B constitutes a high velocity air nozzle in the form of an inclined metal tube 20 which draws the dirty granules 10 from hopper C and feeder tube 19 for propulsion by way of Transvector B1 through orifice 4 into the elutriation column A. The hopper C is a generally funnel-shaped bowl which empties its contents on demand into feeder tube 19 and thence into the lower portion of inclined tubular member 20. A compressed air conduit 22 first draws the dirty granule feed through the lower bend 25 of the feeder tube into the inclined tubular member 20. Ambient air enters tubular member 20 through openings 27 and intermixes with the dirty granules. Then, the transvector B1 squirts the granules 10 and entrained ambient air into the vertical tube 2.

As best shown in U.S. Pat. No. 4,046,492, the Transvector B1 is an air flow amplifier that increases air flow without any moving parts by means of an energy transfer process. The transfer process induces motion in the free surrounding air within a duct or conduit by employing a small amount of compressed air as a power source to move large volumes of air in said duct. An impulse principle of the Transvector accelerates a large mass of air at relatively low velocity to feed air from compressor conduit 24 into the injector tube B to carry the entrained dirty granules 10 into position for being acted upon by the transvector B1. Amplification ratios up to 20 times greater than the compressed air supply allows the ducted air flow to run about 100 CFM.

Referring to FIG. 2, a jet of clean compressed air drawn through injector conduit 24 is forced into annular space 26 within Transvector housing 28 to propel the clean air passed annular lip 30 and thence through barrel 32 of housing 28. This causes the low velocity air with its dust entrained granules to be blasted through the Transvector B1 and against polyurethane pad 6 mounted on the opposite wall of the elutriation tube 2.

Figure 3:
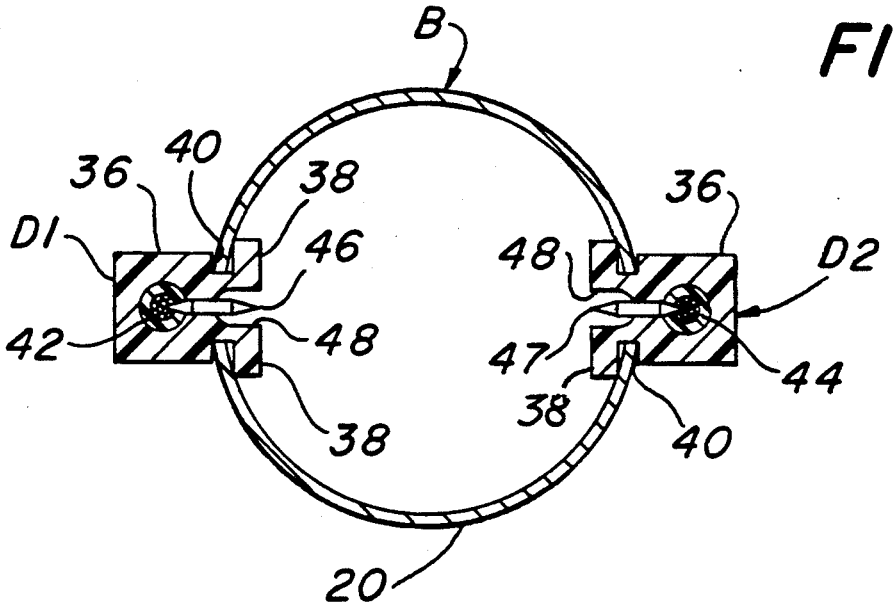
FIG. 3 is a sectional view taken along lines 3—3 of FIG. 2.
Figure 4:
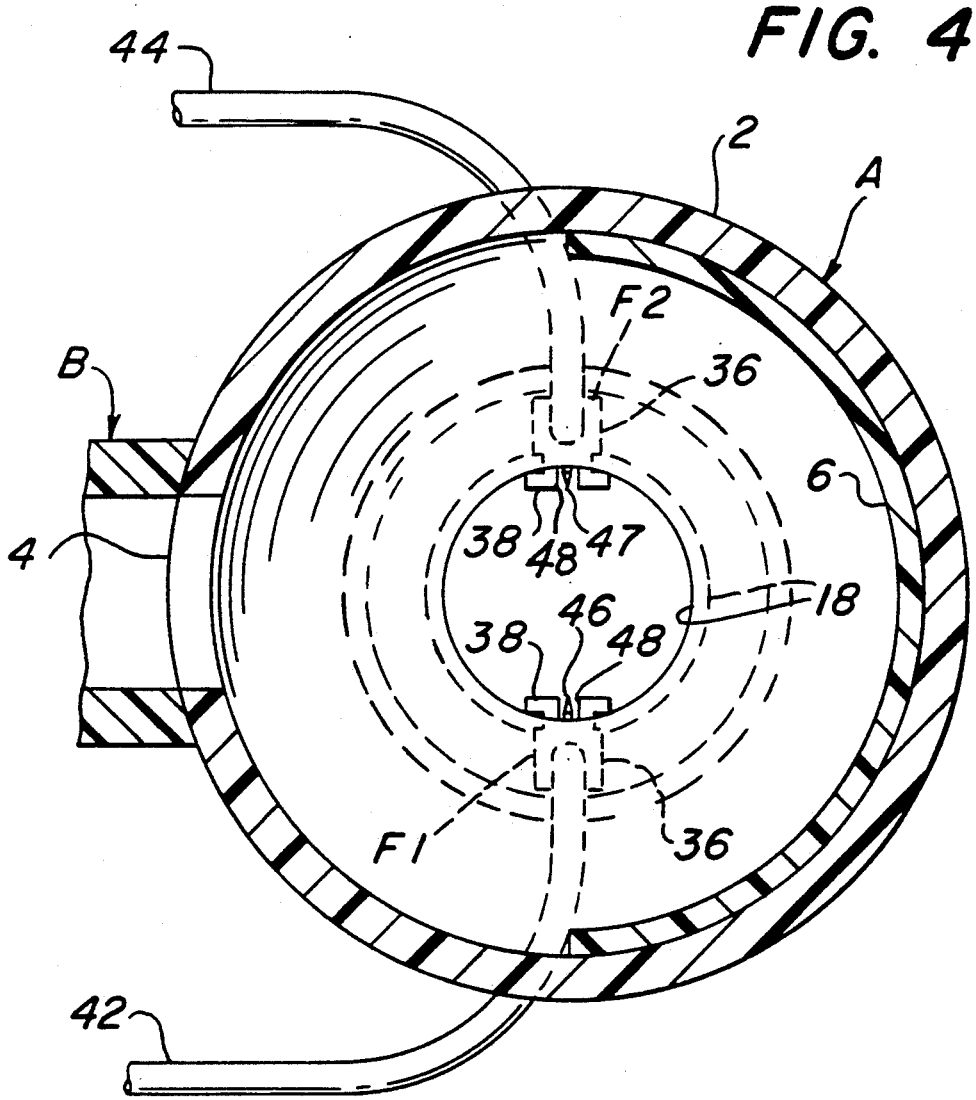
FIG. 4 is a sectional view taken along lines 4—4 of FIG. 2.

Referring next to FIGS. 3 and 4, the electrostatic neutralizers D1 and D2 (mounted in injector tube B) and F1 and F2 (mounted in the lower portion of the elutriation column A) each comprise a longitudinally extending bar 36 of insulative material, such as polystyrene or Teflon, made by E. I. duPont de Nemours of Wilmington, Del., having a flanged portion 38 defining slots 40 which attach to the cylindrical wall of the injection tube 20 or correspondingly to that of the down tube 18 of the elutriation column. The conductive metal injector tube 20 and the conductive metal down tube 18 of the elutriation column A act as spaced reference electrodes for the points 46 and 47 of the respective electrostatic neutralizers D1–D2 and F1–F2 to enable A.C. ion emission from said points.

A general description of said electrostatic neutraliizers or static eliminators D1, D2, F1 and F2 is shown in U.S. Pat. No. 3,137,806 to Schweriner, except that the prior devices employ a grounded housing whose flanges are adjacently spaced from the pointed electrodes thereof. An insulated conductive cable 42 is threaded through a bore in bar 36 of static neutralizers D1 and F1 while an insulated conductive cable 44 longitudinally extends through the bore of the oppositely disposed static neutralizers D2 and F2. Longitudinally spaced conductive needles 46 pass through complementary apertures in the bars 36 of neutralizers D1 and F1 into engagement with the central conductor 42 and extend through a medial slot 48 therein into the hollow space defined by the walls 18 or 20. Longitudinally spaced conductive needles 47 pass through complementary apertures in the elongated bars 36 of neutralizers D2 and F2 into engagement with the central conductor of cable 44. When the neutralizers D1 and D2 are mounted in diametrically opposed disposition in the walls of injection tube 20 the needle electrodes 46 and 47 face one another. Similarly when the neutralizers F1 and F2 are mounted in diametrically opposed disposition within the walls 18, the needle electrodes 47 project through the slot 48 of the corresponding bar 36 into the interior of the down tube 18 and face the pointed electrodes 46 thereof.

Figure 5:
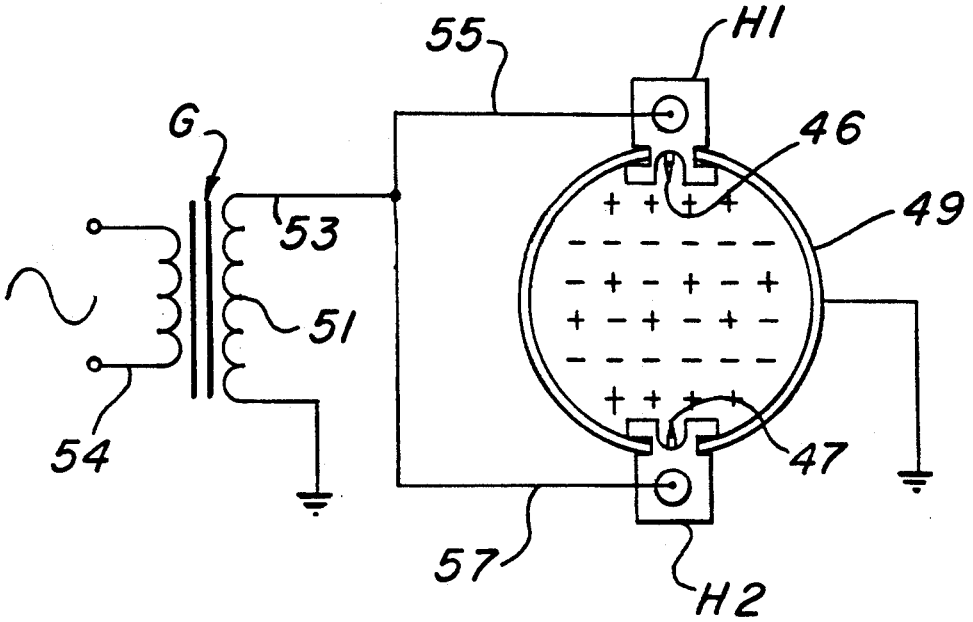
FIG. 5 PRIOR ART
FIG. 5 is an electrical schematic diagram of the prior art circuit coupled to single phase static neutralizer means.

Referring now to FIG. 5, the mode of operation of the prior art electrostatic elimination system embodies a pair of diametrically opposed static neutralizers H1 and H2 oriented on the opposite walls of a metal tube 49 and whose discharge electrodes 46 and 47 are both connected to one side of an A.C. high voltage power supply G. That is, the high side of the transformer secondary 51 is connected to common lead 53 branching off to lines 55 and 57 coupled to the points 46 and 47 of each of the static neutralizers H1 and H2 while the low side of the transformer secondary is connected to ground. The metal tube 49 is also coupled to ground. It has been found that a slight excess of negative ions are produced by this system and a predominant negative charge is produced on particulate material passing through the tube 49.

Figure 6:
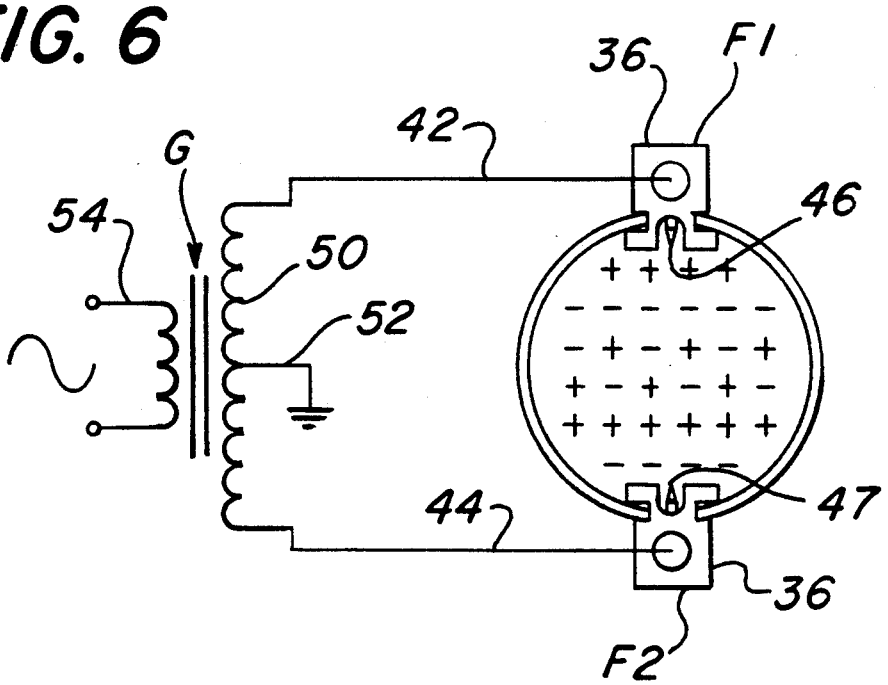
FIG. 6 is a schematic diagram of the circuit of the electrostatic neutralizer means of the present invention.

Referring next to FIG. 6, the opposed static neutralizers D1–D2 and F1–F2 of the present invention are coupled to the opposite sides of secondary coil 50 of the A.C. high voltage power supply G and the transformer secondary 50 itself is center tapped to ground via lead 52. In this hook-up, a positive half cycle of voltage imposed on the primary 54 of the power supply G will appear as a positive half cycle of voltage on cable 42 and points 46 while a negative half cycle of voltage is imposed on the points 47 via cable 44. When a negative half cycle of voltage is applied to emitter points 46 via cable 42, a positive half cycle of voltage is applied to points 47 by way of cable conductor 44.

It is to be observed that the points 46 and 47 of static neutralizers D1–D2 and F1–F2 are not close to or adjacently spaced from ground and tube 18 of the elutriation column A (and tube 20 of the injector tube B) remain ungrounded. By energizing the points 46 and 47 with reverse polarity dual phase A.C. high voltage and allowing the tubes 18 and 20 to float, the granular material passing between the bipolar ionizers D1-D2 and F1-F2 can assume a balanced state of ionization leading to a zero charge disposition.

Figure 7:
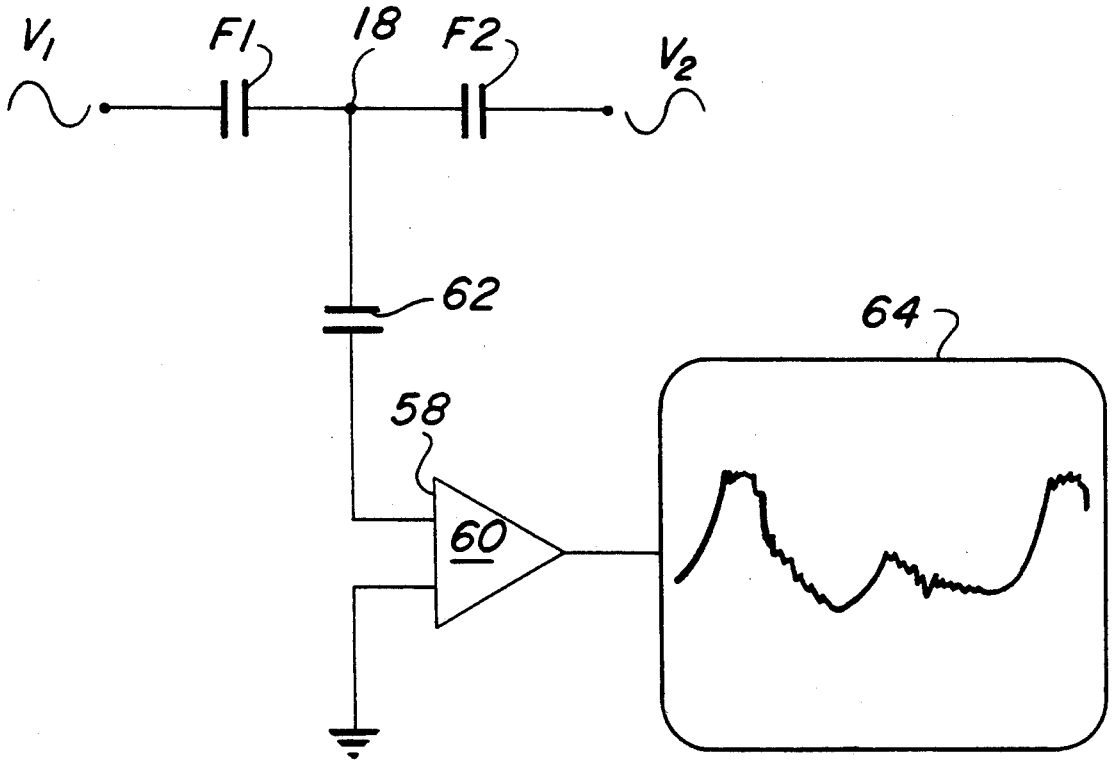
FIG. 7 is a schematic diagram of the test circuitry for measuring the reference electrode voltage with respect to ground of the present invention.

In FIG. 7, there is shown a test set up in which one ionizer, for example F1, is coupled to voltage V1 of phase A from one side of the secondary coil 50 by way of cable 42 while the other ionizer F2 arranged in diametrically opposing disposition is coupled to voltage V2 from phase B of the other side of the secondary coil via conductor 44. The tube 18 was allowed to float (no ground connection).

Material in the form of pellets carrying a charge of approximately +2.5 nC/g (nano Coulombs per gram) was passed through the tube 18 by gravity, for example. The pellets emerged with a level of charge of approximately 2 pC/g (pico Coulombs per gram). This is an extremely low residual charge, the charge level having been reduced by a factor of one thousand from the original charge. It was also observed that the polarity of the residual charge on repeated tests was not consistent, and the mathematical sum of the various tests (taking polarity into consideration) approached zero thereby indicating balanced ionization within the tube 18.

The A.C. and D.C. voltage on the tube 18 was measured using a non-contact electrometer type field meter 60 adjacently spaced from the tube 18 by way of an air space of about ¼ inch distance (i.e.- designated by capacitance 62). The voltage on the wall of tube 18 with respect to ground provided one input 58 to the fieldmeter 60 and fieldmeter output was connected to an oscilloscope 64. This provided a very high impedance arrangement for measuring voltages on the tube 18.

Using this set-up, a non-sinusoidal A.C. waveform in the order of approximately 400 $V_{p-p}$ was observed. The D.C. offset under the foregoing conditions was approximately −230 $V_o$. Theoretically, with $V_1$ equal to $V_2$ but 180° out of phase and the voltages on F1 equal to F2, the A.C. voltage on the tube 18 will be zero (0). This would indicate that the measured A.C. voltage of 400 $V_{p-p}$ on the tube is primarily due to ionization currents. Similarly, the measured D.C. offset of 230 V would also be due to ionization currents. However, because we know that the emerging pellets upon exiting from the dual-phase static neutralization floating-conduit system are basically neutral, the ionization within said tube is balanced. This leads to the conclusion that the D.C. offset on the tube counters the effects of the difference in ionization offset voltage and difference in ion mobility, thereby producing a balanced ion emission.

In contradistinction when a "hot" ionizer is used, one with the ionizing points connected directly to the transformer high voltage output and the outer case connected to ground, for example, as shown in FIG. 5, a negative ion imbalance is the result. This negative ion imbalance is due primarily to the fact that the negative corona onset voltage is lower than the positive corona onset but also because the difference in negative ion mobility plays a role in ion imbalance. In the case of the FIG. 5 arrangement, when pellets having a charge of approximately +2.5 nC/g (nano Coulombs per gram) were passed through the grounded metal tube, the charge on the pellets was reduced to approximately −0.31 nC/g. Thus, the charge level was reduced only by a factor of about ten and the polarity of the charge reversed to become negative. This would indicate that where single-phase static neutralizers are employed (i.e. the same A.C. high voltage being applied to the emitter points at the same time) and the metal tube grounded (i.e. adjacent ground), that neutralization would occur but a low level of residual static charge would be deposited on the pellets due to imbalance of the air ionizers.

Suitable air pressure gauges 70 and 72 on the face of the cleaning apparatus enable the operator to feed air at a predetermined pressure from compressed air sources (not shown) to the compressed air conduits 22 and 24 in order to inject the dirty granules through the injection tube B and into the elutriation column A to provide a fluidized bed at the desired level. The vacuum applied to the tubular conduit 12 is monitored by vacuum gauge 74 to insure that adequate vacuum level is maintained and assure complete collection of the lighter weight particulate.

Although this invention has been described in considerable detail, such description is intended as being illustrative rather than limiting, since the invention may be variously embodied, and the scope of the invention is to be determined as claimed.

We claim:

1. Apparatus for cleaning granules and the like having lighter weight particulate material entrained therewith, comprising:

(a) a hollow elutriation column, (b) injector means for squirting dirty granules on a stream of air into said elutriation column to form a fluidized bed therein at a medial portion thereof, (c) electrostatic ionizer means coupled to said injector means and subjecting the dirty granules to bipolar ionization before said dirty granules enter said elutriation column whereby the granules are neutralized and release entrained particulate therefrom, (d) suction means for drawing off the lighter weight particulate material from the upper portion of the fluidized bed whole allowing the heavier granules to separate therefrom and fall to the bottom of the elutriation column by gravity, and (e) means to collect the falling clean granules for re-use, said electrostatic ionizer means comprising pairs of facing static bars coupled to opposite sides of a high voltage A.C. transformer so that the emission from one static bar is 180° out of phase with that of the other.

2. The apparatus of claim 1 including second electrostatic ionizer means positioned in said elutriation column below the fluidized bed.

3. The apparatus of claim 2 wherein the lower portion of the elutriation column tapers down to an elongated narrow zone in which the second ionizer means are disposed, said lower portion of said elutriation column being conductive to constitute a reference electrode for said second ionizer means.

4. The apparatus of claim 1 wherein said injection means comprises a hollow tube inclined with respect to said elutriation column and having a port communicating with a lower interior portion thereof.

5. The apparatus of claim 4 wherein said injection means includes an air amplifier for transporting the dirty granules on a high speed stream of air into said elutriation column.

6. The apparatus of claim 5 wherein said injection means propels the stream of dirty granules against an impact pad on a wall of said elutriation column opposite the port.

7. Apparatus for cleaning granules and the like having lighter weight particulate material entrained therewith, comprising:

(a) a hollow elutriation column, (b) injector means for squirting dirty granules on a stream of air into said elutriation column to form a fluidized bed therein at a medial portion thereof, (c) electrostatic ionizer means coupled to said injector means and subjecting the dirty granules to bipolar ionization before said dirty granules enter said elutriation column whereby the granules are neutralized and release entrained particulate therefrom.

(d) suction means for drawing off the lighter weight particulate material from the upper portion of the fluidized bed while allowing the heavier granules to separate therefrom and fall to the bottom of the elutriation column by gravity, and (e) means to collect the falling clean granules for re-use, said injection means including a conductive tubular member supporting said electrostatic ionizer means and constituting a reference electrode therefor, said electrostatic ionizer means comprising a pair of diametrically opposed static bars having pointed electrodes facing one another within said conductive tubular member, and a high voltage A.C. power supply having a center-tapped-to-ground secondary coil whose opposite sides are coupled to the facing pointed electrodes of the diametrically opposed pair of static bars.

8. The apparatus of claim 7 wherein said reference electrode is isolated from ground whereby said electrostatic ionizer means electrically floats with respect to ground in reverse phase disposition to effect balanced ion emission.

9. Apparatus for cleaning granules and the like having lighter weight particulate material entrained therewith, comprising:

(a) a hollow elutriation column, (b) injector means for squirting dirty granules on a stream of air into said elutriation column to form a fluidized bed therein at a medial portion thereof, (c) electrostatic ionizer means coupled to said injector means and subjecting the dirty granules to bipolar ionization before said dirty granules enter said elutriation column whereby the granules are neutralized and release entrained particulate therefrom, (d) suction means for drawing off the lighter weight particulate material from the upper portion of the fluidized bed while allowing the heavier granules to separate therefrom and fall to the bottom of the elutriation column by gravity, (e) a U-shaped bend at the top portion of said elutriation column for impeding fine particulate drawn off by said suction means from falling back onto the fluidized bed and recombining with the heavier granules, (f) an ambient air inlet intermediate said U-shaped bend and said suction means to facilitate balancing the height of the fluidized bed in said elutriation column, and (g) means to collect the falling clean granules for re-use.

10. Method for cleaning granules having lighter weight particulate material entrained therewith comprising the steps of:

(a) feeding dirty granules on a stream of bipolar ionized air into a vertically disposed elutriation column to effect neutralization of the granules and the entrained materials so as to produce multi-level fluidization thereof as a floating suspension within the elutriation column, (b) drawing off the lighter weight particulate material at the upper portion of the floating suspension by suction, (c) allowing the heavier weight cleaned granules to separate from the floating suspension by falling by gravity to the bottom of the elutriation column, and (d) collecting the cleaned granules at the bottom of the elutriation column for re-use, the stream of bipolar ionized air being produced by exposing the dirty granules to dual phase emission from pairs of facing static bars coupled to opposite sides of a high voltage A.C. transformer so that the emission from one static bar is 180° out of phase with that of the other.

11. The method of claim 10 wherein the cleaned granules falling through the elutriation column are exposed to a second set of opposed static bars coupled to opposite sides of a high voltage A.C. transformer, said second set of opposed static bars having a reference electrode isolated from ground.

12. Apparatus for cleaning granules and the like having lighter weight particulate material entrained therewith, comprising:

(a) a hollow elutriation column, (b) injector means for squirting dirty granules on a stream of air into said elutriation column to form a fluidized bed therein at a medial portion thereof, (c) electrostatic ionizer means coupled to said injector means and subjecting the dirty granules to bipolar ionization before said dirty granules enter said elutriation column whereby the granules are neutralized and release entrained particulate therefrom, (d) suction means for drawing off the lighter weight particulate material from the upper portion of the fluidized bed while allowing the heavier granules to separate therefrom and fall to the bottom of the elutriation column by gravity, and (e) means to collect the falling clean granules for re-use, said injector means comprising a hollow tube upwardly inclined with respect to said elutriation column and having a port communicating with the interior portion thereof below the level of the fluidized bed whereby falling heavier granules within said elutriation column will be restrained from entering into said injection means.

13. The apparatus of claim 12 wherein the hollow tube of said injection means comprises an ungrounded conductive portion spaced opposite from said electrostatic ionizer means to provide a balanced ion emission therefrom.

* * * * *